US005358595A

United States Patent [19]

Williams

[11] Patent Number: 5,358,595

[45] Date of Patent: Oct. 25, 1994

[54] LABEL FEEDER FOR OPEN-TOP CONTAINERS

[76] Inventor: Roger S. Williams, 1777 Bethel New Richmond Rd., New Richmond, Ohio 45157

[21] Appl. No.: 132,519

[22] Filed: Oct. 6, 1993

[51] Int. Cl.[5] ..... B65B 61/00

[52] U.S. Cl. ..... 156/571; 53/157; 53/415; 271/269; 271/271

[58] Field of Search ..... 156/571, DIG. 31, 570; 271/264, 267, 269, 271, 275, 277; 264/509; 53/50, 250, 157, 415

[56] References Cited

U.S. PATENT DOCUMENTS

| | | | |
|---|---|---|---|
| 1,261,595 | 4/1918 | Mulet | 156/571 X |
| 3,145,603 | 8/1964 | Biben | 271/271 X |
| 4,636,166 | 1/1987 | Franks et al. | 156/DIG. 31 X |
| 4,741,145 | 5/1988 | Bright et al. | 53/50 X |

*Primary Examiner*—David A. Simmons

*Assistant Examiner*—James J. Engel, Jr.

*Attorney, Agent, or Firm*—Kinney & Schenk

[57] ABSTRACT

A label feeder for use with an automated packaging machine wherein open-top containers are moved along a conveyor line. The label feeder comprises an open frame with a substantially horizontally extending supporting arm extending therefrom and a motor mounted thereon. The supporting arm has at least one label hold bin for holding the labels mounted on it as well as an endless conveyor for moving the label from the label hold bin to a position directly over the open-top container. A loading ram system and an unloading ram system, each with vacuum means, are mounted on the supporting arm to pick a label from the hold bin and deposit a label into the containers, respectively. The label feeder is portable and is used as needed in association with the packaging machine to place the individual label into the open-top container either before or after the articles have been added and before the container is sealed close.

9 Claims, 8 Drawing Sheets

LABEL FEEDER FOR OPEN-TOP CONTAINERS

This invention relates to a label feeder. More particularly, the invention relates to a label feeder which delivers individual labels to open-top containers as the containers move along a packaging conveyor.

Automated packaging of manufactured articles into containers is used in many industries. The food packaging industry in particular extensively uses automated equipment for efficiently loading food articles into containers. Sanitary conditions must be maintained. Hermetic sealing of the loaded containers must be accomplished. Many different models of equipment are currently offered for sale to the food industry. The equipment is normally engineered to handle the specific food articles and the specific type of container which is selected for holding the articles.

Any packaged article must necessarily be properly identified. This is accomplished in different ways. For example, the container itself will have identifying information printed directly onto its outside surface. A printed wrap which extends at least partially around the articles within the container is commonplace. Labels with identifying information are also very often adhered to the outside of the container. The amount of identifying information which can be provided is limited by the container size and/or label size. This is troublesome in part because of recently mandated federal regulations on food article content such as the nature of the ingredients in the food article and nutritional facts about the food article. Additionally, the food article producer may want to include promotional material as a part of the packaged product, e.g. cents-off coupons.

In accord with a need in the article packaging industry and particularly in the food industry, there has now been developed a machine for use with a packaging conveyor line for the purpose of inserting labels into open-top containers. The machine is portable in nature and capable of being moved to the conveyor line to meet special needs. The machine is a label feeder which automatically dispenses individual labels into an open-top container prior to the container being sealed close.

SUMMARY OF THE INVENTION

A label feeder is adapted for use with a conveyor line of an automated packaging machine. It is capable of inserting individual labels into open-top containers as they move along the conveyor line. The label feeder comprises an open frame having a supporting arm and a motor mounted thereon. At least a portion of the supporting arm extends substantially horizontally from the open frame and overlies the conveyor line when in use. An endless conveyor for the labels is mounted on the supporting arm to receive individual labels from a label hold bin also mounted on the supporting arm and to convey them to a position directly over an open-top container on the conveyor line. The supporting arm also has mounted on it a loading ram system with a vacuum means for pulling a label from the hold bin and depositing it on the endless conveyor. An unloading ram system also mounted on the supporting arm pulls the label from the endless conveyor with vacuum means and inserts it into the open-top container. The label feeder is portable in nature and is used with packaging machines when it is desired to insert labels containing content information or promotional information.

DETAILED DESCRIPTION OF THE INVENTION

The label feeder of the invention is described in detail in the following paragraphs and with particular reference to the drawings. The label feeder is capable of being used with packaging equipment for all types of articles wherein an open-top container is being utilized. Packaging of food articles, particularly frankfurters, in open-top containers is of primary interest and, for this reason, this end use is described.

Figure 1:
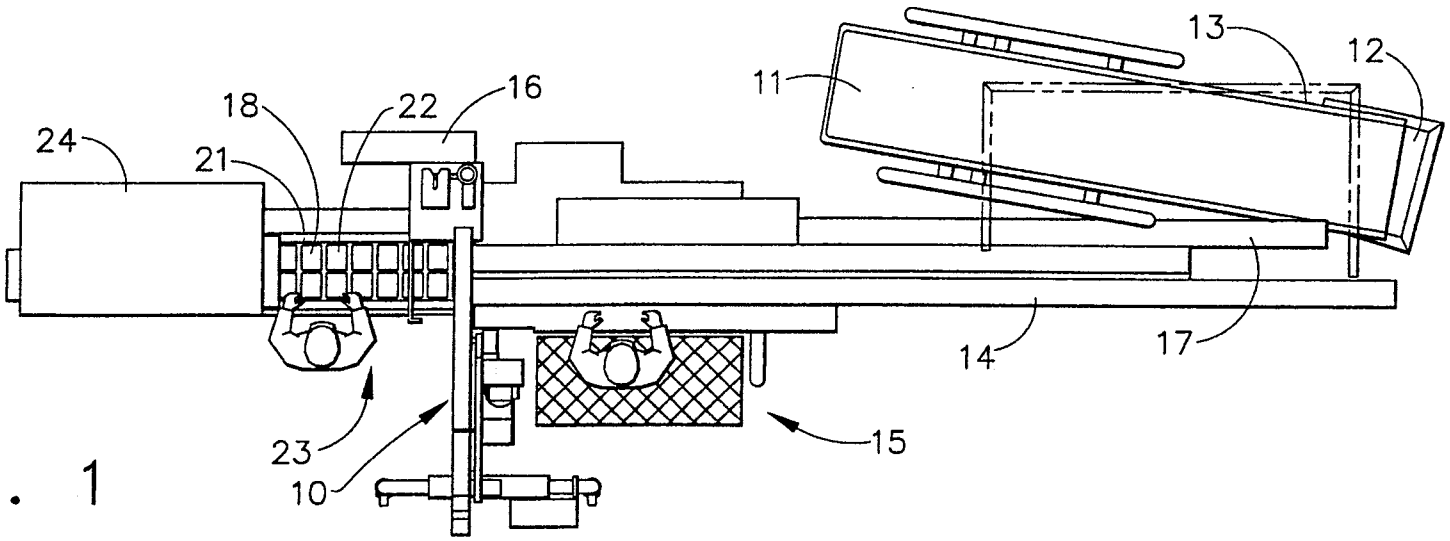
FIG. 1 is a top view of a frankfurter packaging machine with the label feeder of the invention in operable position.
Figure 2:
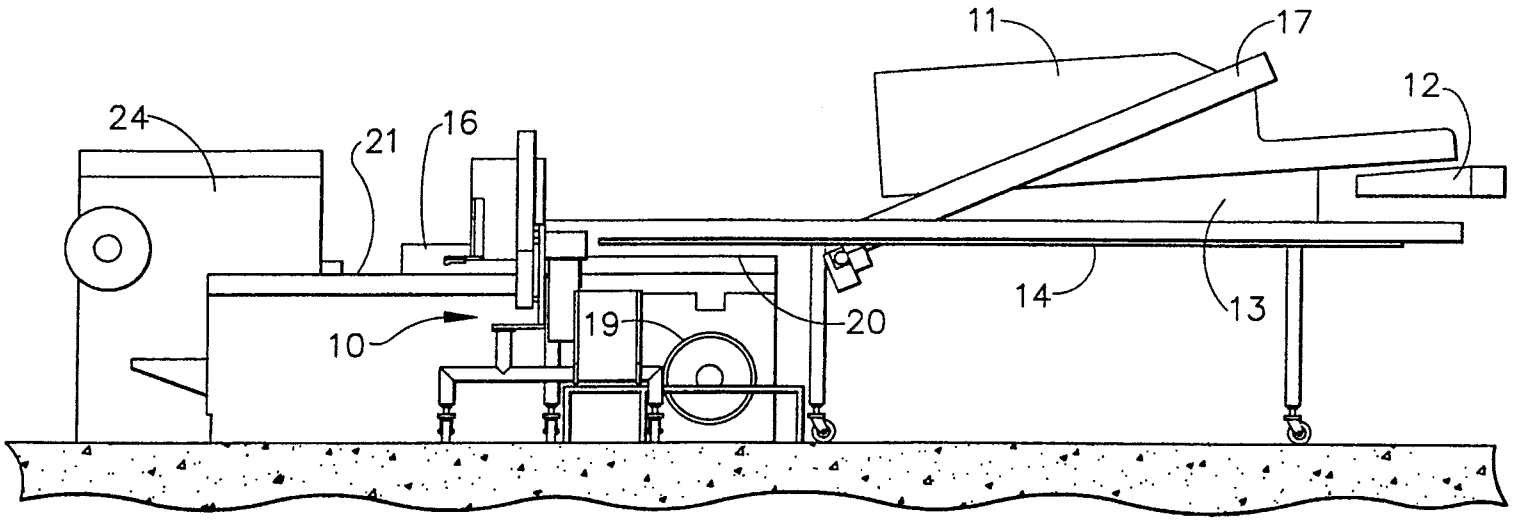
FIG. 2 is an elevational view of the packaging machine of FIG. 1.
Figure 3:
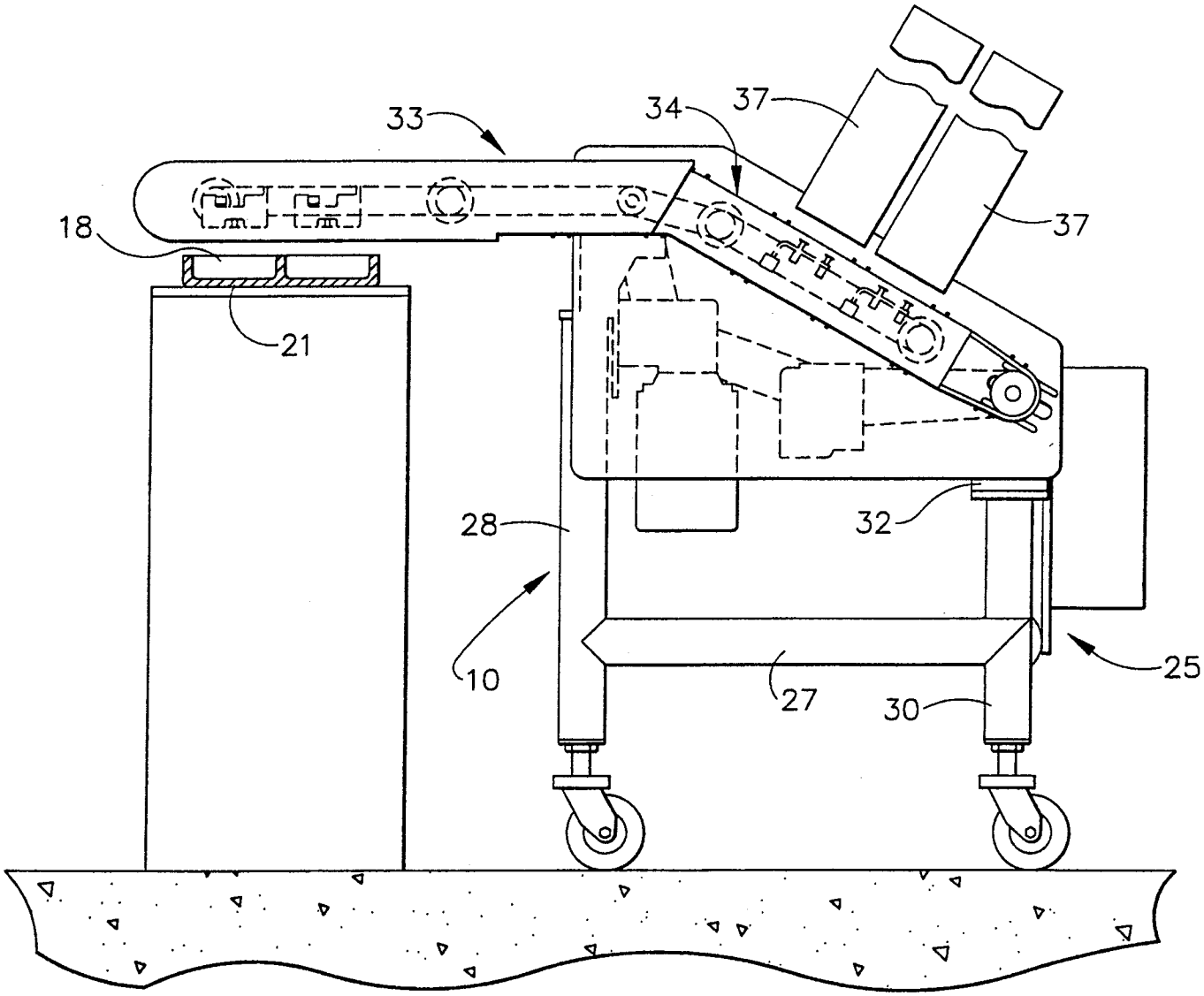
FIG. 3 is an elevational view of the label feeder of the invention in operable position with the conveyor line of the packaging machine of FIG. 1.
Figure 4:
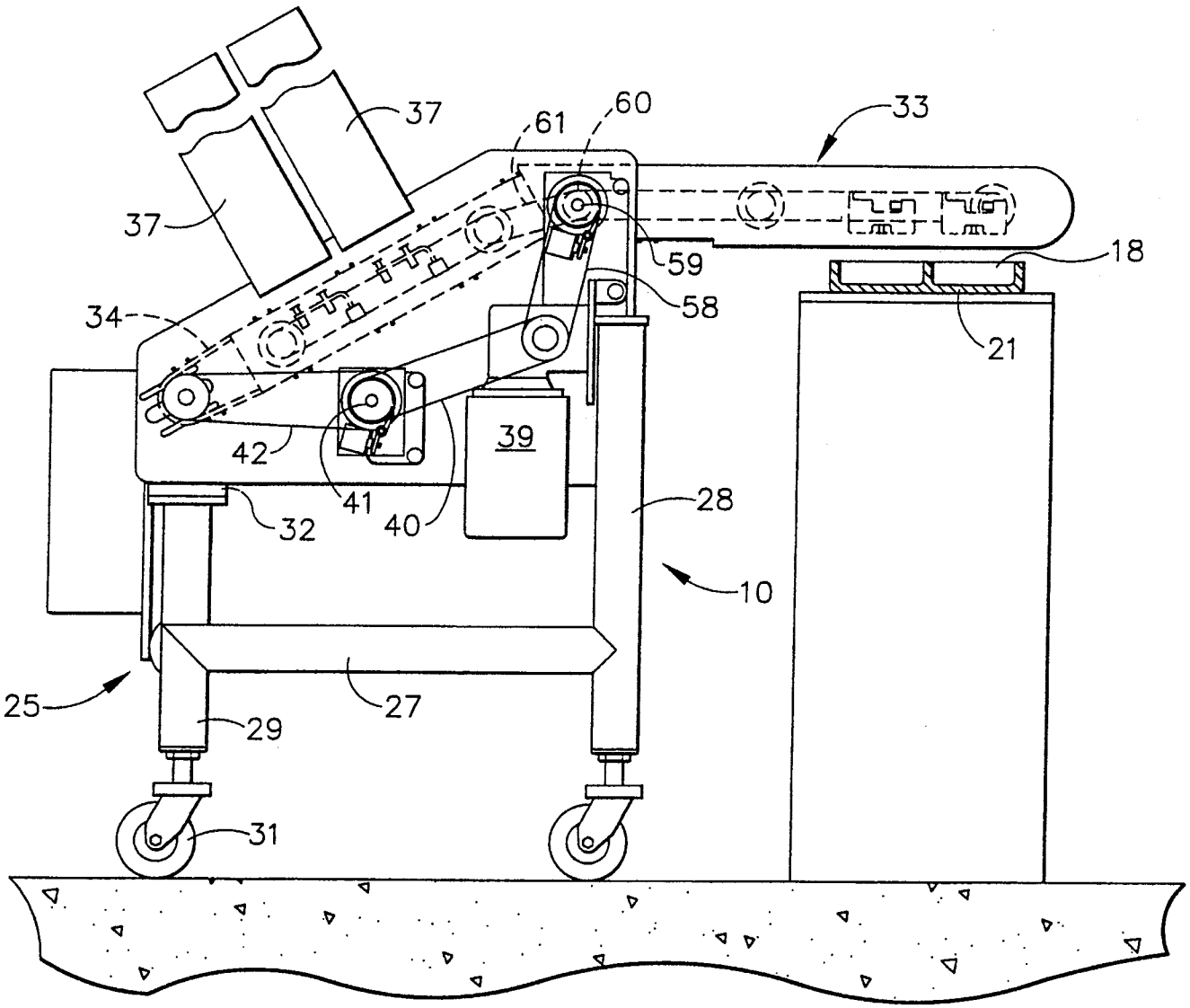
FIG. 4 is another elevational view of the label feeder of FIG. 3 as viewed from an opposite side.
Figure 5:
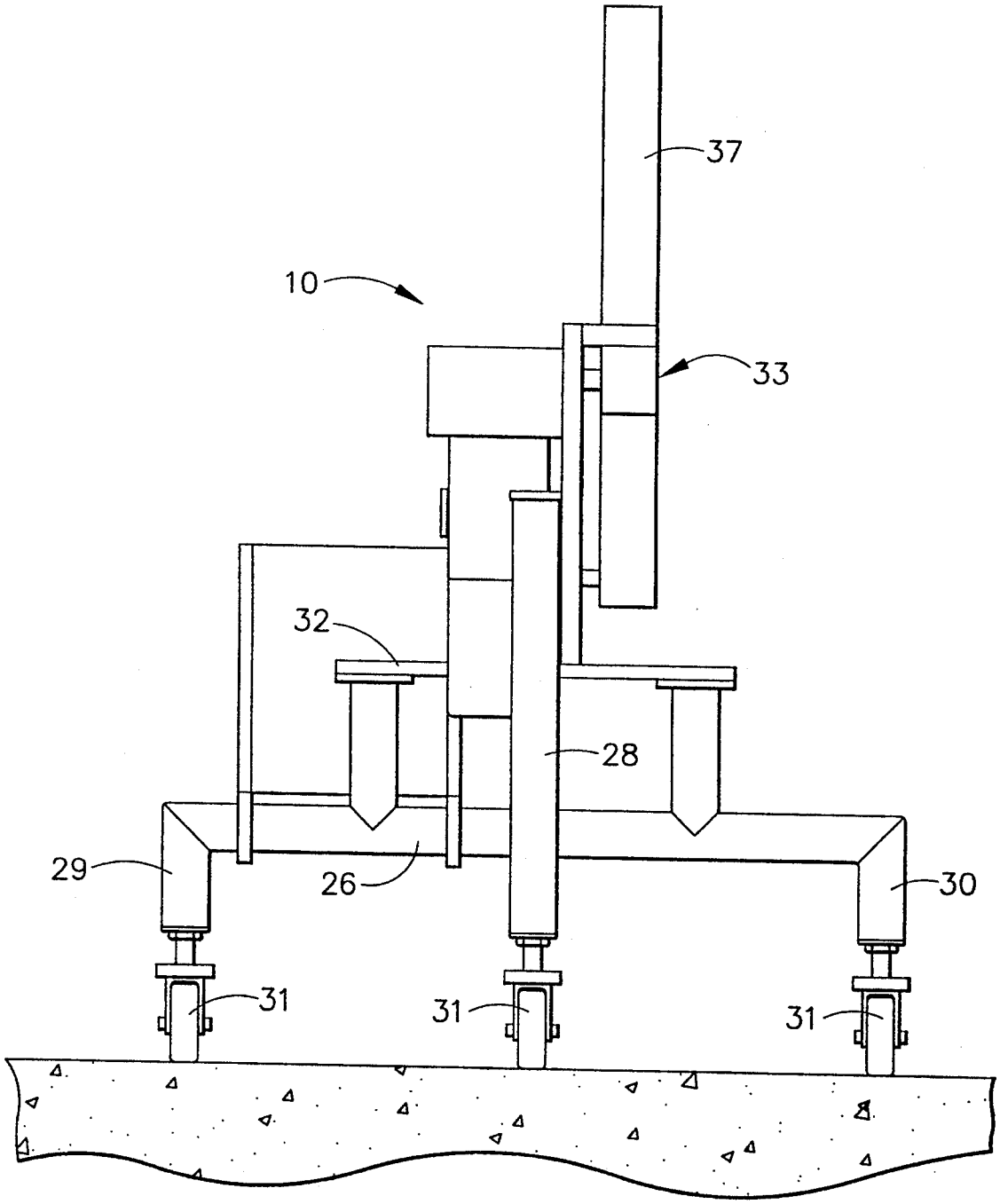
FIG. 5 is an end view of the label feeder of FIG. 3.
Figure 6:
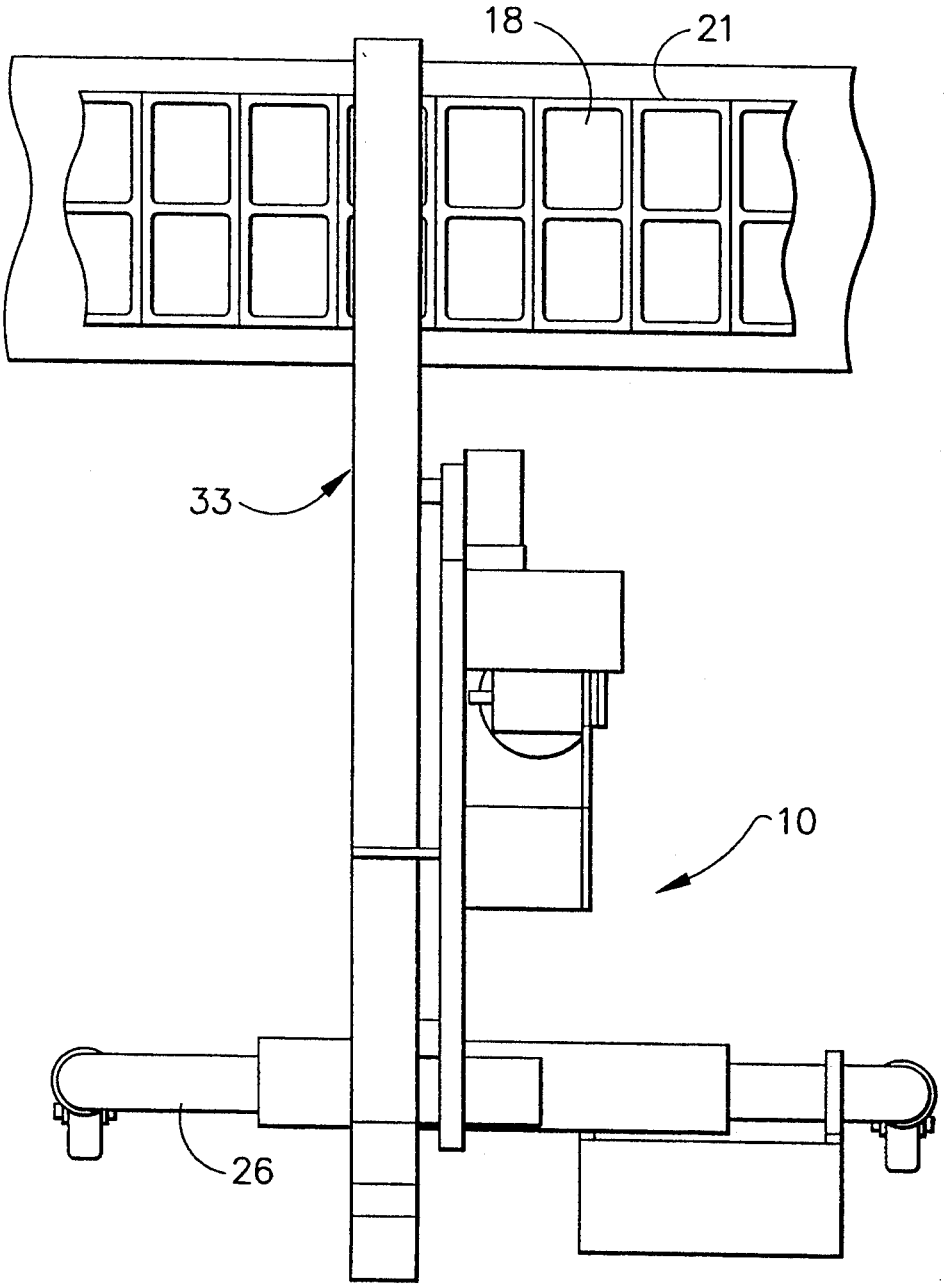
FIG. 6 is a top view of the label feeder of FIG. 3.

Referring to FIGS. 1 and 2, there is shown the label feeder 10 of the invention in operable position with a commercially available packaging machine. Frankfurters ready for packaging are initially fed into a hopper 11 and from there into a flow distributor 12 and a launcher 13 prior to being deposited onto a feed conveyor line 14. The frankfurters travel along the feed conveyor line 14 in a transverse side by side relationship pass a pre-load inspection station 15 and into a frankfurter loading machine 16. An excess conveyor line 17 ensures an orderly array of frankfurters on the feed conveyor line 14 by directing any excess frankfurters back into the hopper 11. Open-top containers 18 are formed from the film 19 after it passes under the film heater 20 and into the cavities of a double row die train conveyor line 21.

The label feeder 10 is wheeled into position so as to insert its labels 22 directly into the open-top containers 18 prior to the frankfurters being transferred from the frankfurter loading machine 16. As should be apparent, the label feeder is capable of being positioned prior to (as shown) or after the open-top containers are loaded with the frankfurters. After the labels are inserted and the frankfurters loaded into the containers, the loaded containers pass a final inspection station 23 and finally pass into a vacuum packaging machine 24 where a top is formed over the containers to hermetically seal each one.

With reference to FIGS. 3–6, there is shown in more detail the label feeder 10 of the invention. It is shown in operable association with the die train conveyor line 21 of the aforementioned packaging machine. The conveyor line 21 is shown as moving a double row of open-top containers 18. The containers 18 are depicted without food articles, though as discussed above, the containers could as well have the food articles already loaded in them as they approach the label feeder 10.

The label feeder has an open frame 25 of a first horizontal support bar 26, a second horizontal support bar 27 extending substantially perpendicular from a midpoint of the first support bar and a substantially vertical support bar 28 mounted at the free end of the second support bar and extending to near the floor. Legs 29 and 30 extend downwardly from the two ends of the first support bar, respectively. Caster wheels 31 are mounted on the vertical support bar 28 and the two legs 29 and 30 to aid in the portability of the label feeder 10.

Also mounted on the open frame 25 with the aid of a support platform 32 and the vertical support bar 28 is a supporting arm 33. The supporting arm has mounted on it an endless conveyor 34, a loading ram system 35, an unloading ram system 36 and at least one label hold bin 37. The endless conveyor 34, loading ram system 35 and unloading ram system 36 are driven by a motor and associated drive chains and drive wheels as further discussed below. A control box on the frame is operably connected to the motor, the ram loading system and the ram unloading system to ensure that labels are picked from the label hold bin, conveyed and discharged in timed relationship to movement of the open-top containers on the conveyor line.

The supporting arm 33 of the label feeder 10 is mounted so that at least the free end of it extends substantially horizontally from the open frame 25 and extends a sufficient distance such that it is capable of being positioned directly overlying the open-top containers 18 on the conveyor line 21. As shown, a portion of the supporting arm mounted to the open frame 25 is inclined from the substantially horizontal free end which overlies the containers. The inclined portion of the supporting arm has mounted on it the label hold bins 37 such that they extend perpendicularly from the supporting arm 33 at the point of attachment. It is preferred to have the label hold bins 37 at an angle so that weight forces created from a stack of labels within each bears partially on its sidewalls and not fully on a retention means at its outlet end. It is for this reason, that the full supporting arm itself is not horizontal.

The endless conveyor 34 on the supporting arm 33 extends substantially the full length of the supporting arm. It is comprised of two parallel endless chains 38 (best seen in FIGS. 9 and 10) which are driven by the motor 39 through an operably connected first drive chain 40, a clutch 41, and a second drive chain 42 (best seen in FIG. 4). The endless chains of the conveyor travel around sprocket wheels and idler wheels mounted on the supporting arm 33. The parallel endless chains 38 are spaced apart to suspend the labels by their edges. Pusher pins 43 are on each of the parallel endless chains 38 to carry the labels along the endless conveyor 34 as it travels around the sprocket wheels on the supporting arm.

Figure 7:
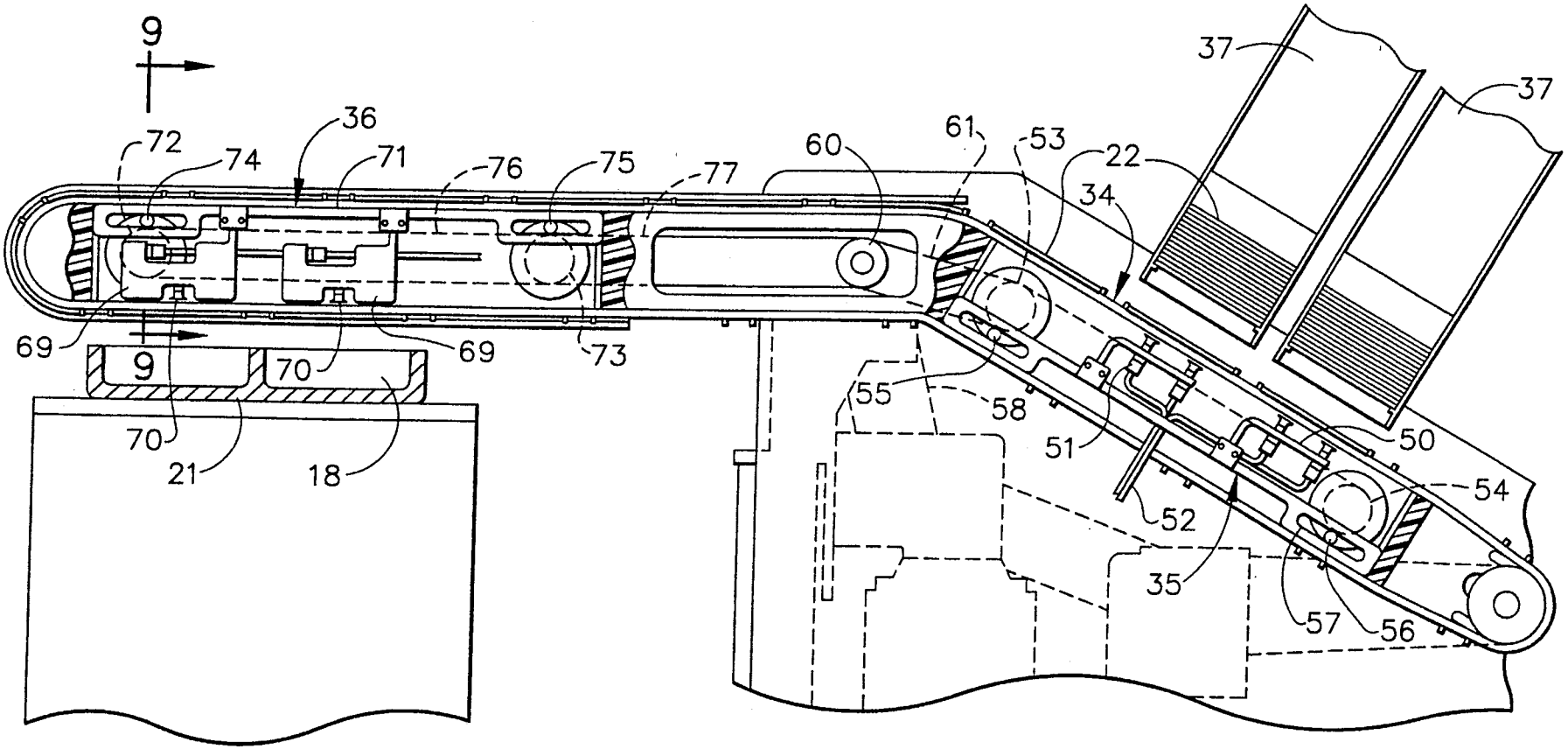
FIG. 7 is a partial elevational view of the label feeder of FIG. 3 with supporting arm casings removed to show a loading ram system and an unloading ram system in fully retracted positions.
Figure 8:
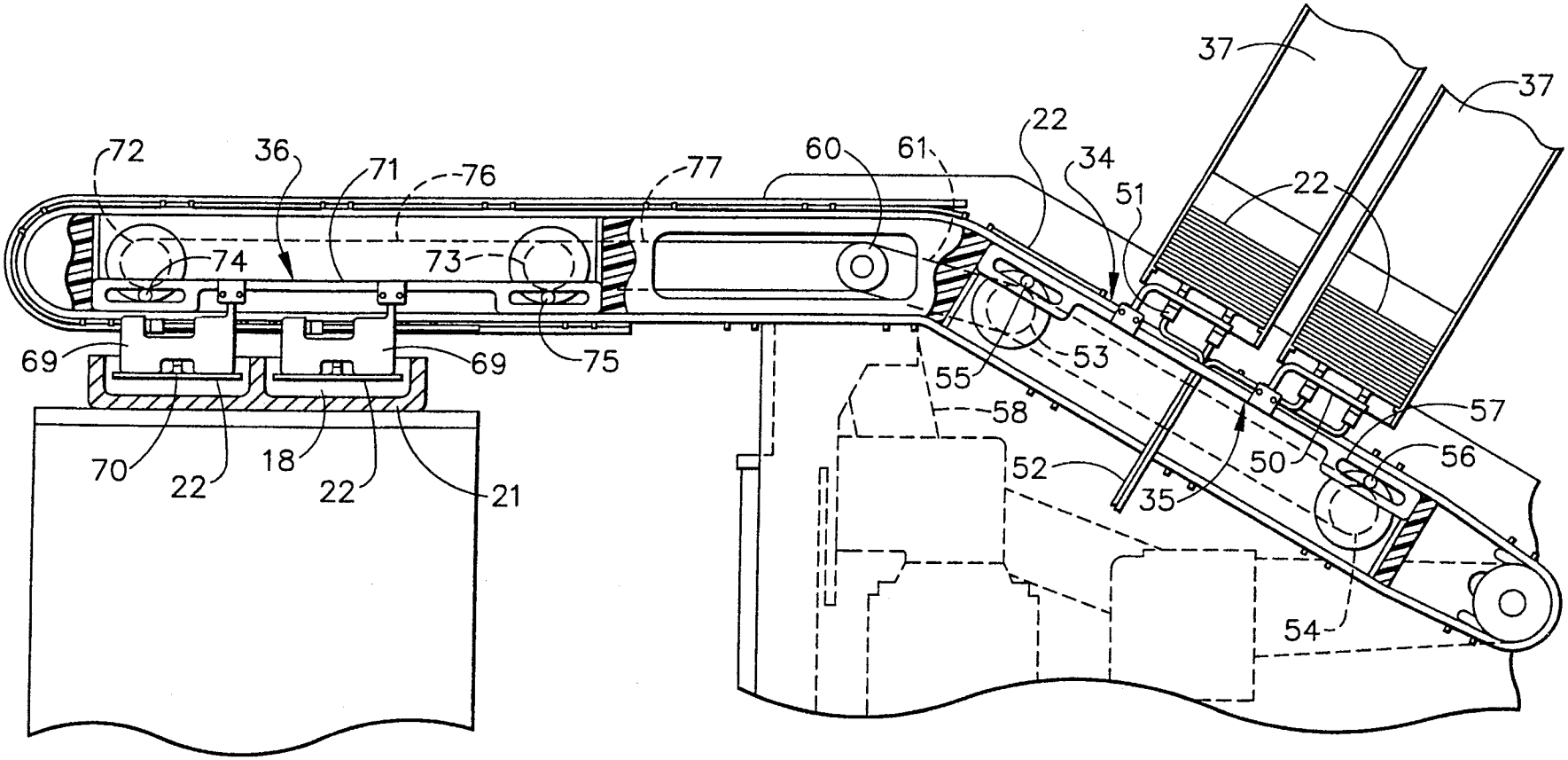
FIG. 8 is a partial elevational view of the label feeder of FIG. 7 showing the loading ram system and unloading ram system in fully extended positions.
Figure 10:
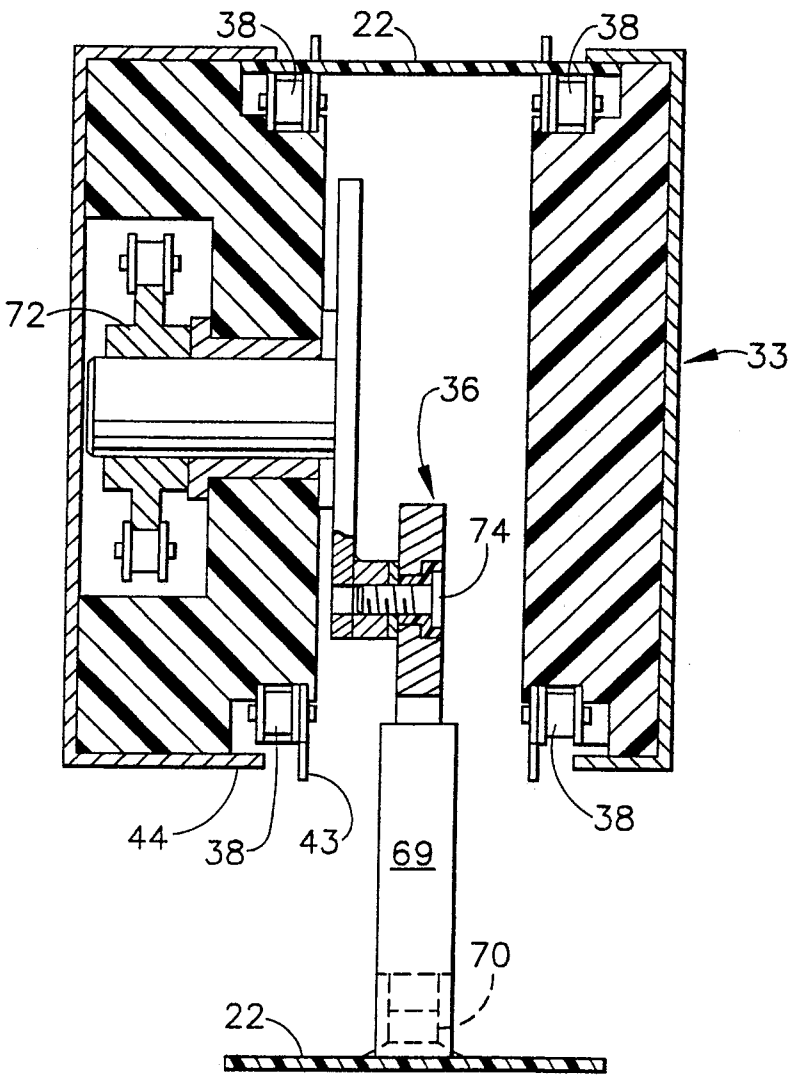
FIG. 10 is a partial end view in section of the endless conveyor and unloading ram system of FIG. 9 in a label discharge position.
Figure 9:
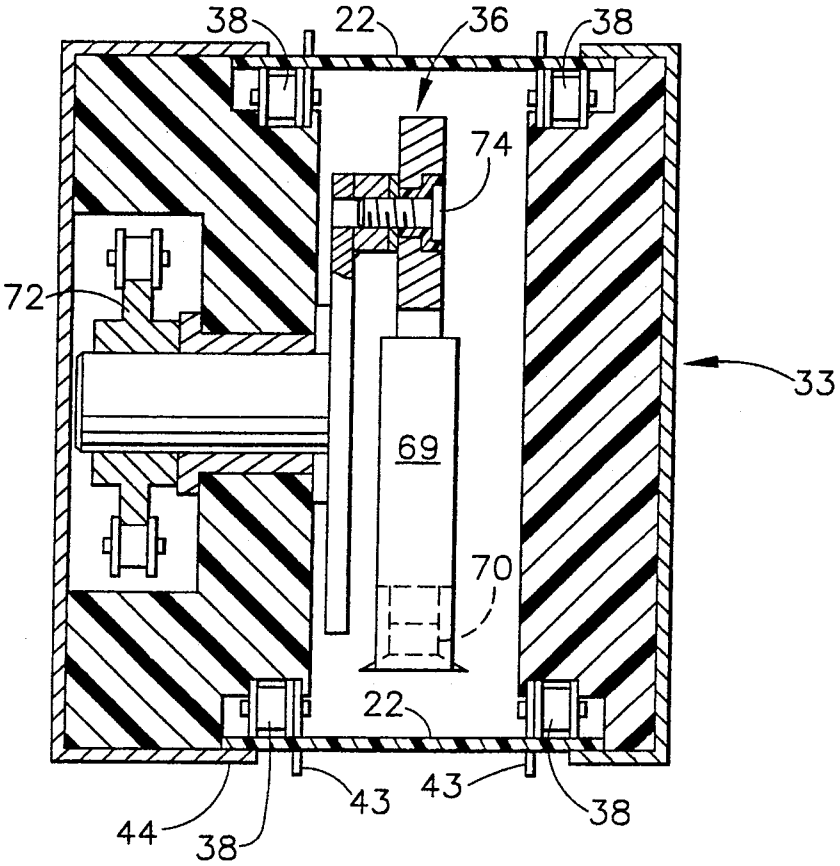
FIG. 9 is a partial end view in section of an endless conveyor and the unloading ram system used on the label feeder supporting arm of FIG. 3.

As seen in FIGS. 9 and 10, associated with the endless conveyor 34 are L-shaped catch brackets 44. Each bracket 44 is mounted on the supporting arm so that one leg runs parallel with the endless chains 38 and is in close association. The purpose of the brackets is to retain the labels 22 in a suspended state as they travel around the outermost sprocket wheel on the free end of the supporting arm and prior to reaching the unloading ram system 36. Labels held in the label hold bins 37 are individually transferred to the endless conveyor 34 by means of the loading ram system 35. As seen in FIGS. 3, 4, 7 and 8, the system 35 comprised of two loading heads is mounted on the supporting arm 33 in operable association with the label hold bins 37. Each loading head of the system has a bracket 50 with at least one vacuum tube 51 extending substantially perpendicular thereto and in direct line with the flat surface of the label 22 to be picked from the label hold bin. Two vacuum tubes 51 are used with each head of the loading ram system 35 to better pull the labels from its label bin holder. The vacuum tubes are connected to a vacuum pump (not shown) through a vacuum line 52. A flared nozzle at the terminus of each of the two vacuum tubes has sufficient vacuum supplied to it to physically pull a label from the label hold bin.

Movement of the bracket 50 and vacuum tubes 51 is effected by sprocket wheels 53 and 54. Cam plates with cam shafts 55 and 56, respectively mounted on a periphery thereof are driven by the sprocket wheels and are connected to a double slotted bar 57. The bar 57 is slidably mounted between two slide blocks on the supporting arm. Initially, power from the output shaft of the motor 39 is transferred by a drive chain 58, to a clutch 59 and then to a sprocket wheel 60 mounted on the supporting arm 33. A drive chain 61 transfers power from the sprocket wheel 60 to the sprocket wheels 53 and 54 and ultimately to the cam shafts. As the cam shafts revolve as the wheels revolve, the slotted bar 57 with its brackets 50 travels from a fully retracted position shown in FIG. 7 to a fully extended position shown in FIG. 8. The fully extended position of the brackets puts the vacuum tubes sufficiently close to the labels that the suction provided by the vacuum tubes pulls a label from the hold bin and holds it as the cam shaft revolves and forces the bracket to retract. As the vacuum tubes with the label secured thereto retracts to a position below the top surface of the endless conveyor, the edges of the label 22 are caught on the two parallel endless chains between pusher pins and remain there. The label is thus deposited on the endless conveyor 34 and is then moved along by the endless conveyor until it reaches the unloading ram system.

The label feeder 10 is depicted as having two loader heads on the loading ram system 35. They move in concert due to the fact each is driven by the same slotted bar 57. It should be understood that more loading heads on the loading ram system could be used in adjacent positions on the supporting arm to pick more labels from an equal number of label hold bins and transfer them to the endless conveyor in a side by side relationship.

The unloading ram system 36 mounted on the free end of the supporting arm 33 operates much the same as the loading ram system 35. Thus, as best seen in FIGS. 7 and 8, the unloading ram system 36 has two unloading heads. Each unloading head has a manifold block 69 with a vacuum tube 70 and further the block is fixedly secured to a double slotted bar 71. The slotted bar 71 is slidably mounted between two slide blocks on the supporting arm. It has closed slots near each end. A set of sprocket wheels 72 and 73 mounted on the supporting arm at each end of the slotted bar drive cam plates which have the cam shafts 74 and 75, respectively mounted on peripheries thereof. The cam shafts move laterally in the slots in response to the sprocket wheels revolving. The sprocket wheels in turn are run by a sprocket chain 76. They are driven by the motor 39 through a sprocket chain 77, through the sprocket wheel 60, clutch 59 and the drive chain 58. As the labels 22 on the endless conveyor travel around the sprocket wheel and are caught by the inwardly extending L-shaped brackets, they approach the unloading ram system. The conveyor pusher pins are configured to accommodate different label sizes and different open-top container sizes. The endless conveyor is stopped when the labels to be inserted are at a predetermined point above the open-top containers. The vacuum tube 70 draws a vacuum and holds a label with sufficient force that it is able to force it down out of the L-shaped brackets and move it downwardly to a predetermined level. This level is determined by the article and container shape. Accurate placement of the labels can be achieved whether the label is to placed in an empty container, on top of the articles, or attached (adhesively or by heat seal) to the inside of the container. As shown, two unloading heads on the ram unloader system act at the same time such that two containers are loaded with the labels at the same time.

The label feeder of the invention is an intermittently operating apparatus which is capable of inserting labels into open-top containers at a relatively high rate. The reciprocating nature of the ram loading and unloading systems while inherently slow in comparison to continuous belt systems is very efficient in part because of the vacuum means used to both load labels onto the endless conveyor and to unload them into the open-top containers.

It should be apparent the label feeder is versatile in its operation. For example, the spacings between pusher pins on the endless conveyor used to move the labels from the loading ram system to the unloading ram system can be changed to accommodate different label sizes and different open-top container sizes. The clutch and sprocket wheels used with the endless conveyor are readily adjusted to handle any such changes. Additionally, the vacuum means on the unloading ram system can reach to varying depths into the open-top containers by changing its sprocket wheels and/or cam plates or by changing the height of the label feeder itself, e.g. by cranking up or down its caster wheels.

In operation, the label feeder of this invention is moved to position adjacent a packaging machine's conveyor line for the open-top containers. It can be positioned at the conveyor line either before or after the articles have been loaded into the containers. The label bin holders are first loaded. The label feeder is operated in synchronization with the conveyor line to transfer the labels individually to each open-top container. Thus, the loading ram system of the label feeder picks labels by its vacuum means one at a time from each hold bin and deposits them onto the endless conveyor. Each label is conveyed along until it reaches the unloading ram system. At that point, the labels are held by the system's vacuum means and forced through the endless conveyor to a position directly above an open-top container. Vacuum is interrupted and the held labels released at a predetermined level and spot with respect to the containers.

While the invention has been described in detail with reference to the drawings, it should be understood various modifications can be made. All such changes of an obvious nature are considered within the scope of the appended claims.

What is claimed:

1. A label feeder for use with a packaging conveyor line to transfer individual labels from a label hold bin into open-top containers as they pass along the conveyor line, said label feeder comprising:

(a) an open frame having mounted thereon (i) a supporting arm wherein at least a portion thereof is capable of extending substantially horizontally from the open frame a sufficient distance to overlie the conveyor line and (ii) a motor;

(b) an endless conveyor for the labels mounted on the supporting arm and driven by the motor, said endless conveyor having sets of pusher pins to receive and hold an individual label and capable of conveying the label to a position directly overlying an open-top container on the conveyor line;

(c) a loading ram system mounted on the supporting arm and driven by the motor, said loading ram system having at least one vacuum means to pull a label from the label hold bin and deposit it onto the endless conveyor for the labels;

(d) an unloading ram system mounted on the supporting arm and driven by the motor, said unloading ram system having at least one vacuum means to pull a label from the endless conveyor and capable of inserting it into an open-top container; and (e) at least one label hold bin mounted on the supporting arm in operable association with the loading ram system to hold a plurality of individual labels in a stacking relationship.

2. The label feeder of claim 1 wherein the endless conveyor for the labels comprises two parallel endless chains mounted on sprocket wheels on the supporting arm.

3. The label feeder of claim 2 wherein there are two adjacent label hold bins mounted on the support arm, two loading heads on the loading ram system mounted on the supporting arm to pull individual labels from the label hold bins and two unloading heads on the unloading ram system mounted on the supporting arm to pull labels from the endless conveyor and insert them into the open-top containers.

4. The label feeder of claim 2 wherein the loading ram system comprises two belt driven sprocket wheels mounted on the supporting arm, each said sprocket wheel driveably connected to a cam plate having a cam shaft mounted on a periphery thereof, a slotted bar with closed slots near each end thereof and positioned such that the cam shafts extend through the slots, at least one bracket fixedly secured on the slotted bar and at least one vacuum tube mounted on the bracket and connected to a vacuum line, wherein timed movement of the sprocket wheels causes movement of the bracket and vacuum tube from a disengaging position to an engaging position relative to the labels in the label hold bin.

5. The label feeder of claim 4 wherein the ram loading system has two vacuum tubes mounted on each bracket such that a single label is pulled from the label hold bin by the two vacuum tubes and deposited onto the endless conveyor.

6. The label feeder of claim 4 wherein the ram loading system is positioned on the support arm such that its vacuum tube moves between and through the two parallel endless chains of the endless conveyor line as the ram loading system moves from its disengaging position to its engaging position.

7. The label feeder of claim 2 wherein the unloading ram system comprises two belt driven sprocket wheels mounted on the supporting arm, each said sprocket wheel driveably connected to a cam plate having a cam shaft mounted on a periphery thereof, a slotted bar with closed slots near each end thereof and positioned such that the cam shafts extend through the slots, at least one manifold block fixedly secured on the slotted bar and at least one vacuum tube mounted on the manifold block and connected to a vacuum line, wherein timed movement of the sprocket wheels causes movement of the manifold block and vacuum tube from an engaging position to a disengaging position.

8. The label feeder of claim 7 wherein the unloading ram system is positioned on the support arm such that its vacuum tube moves between and through the two parallel endless chains of the endless conveyor line as it moves from its engaging position to its disengaging position.

9. The label feeder of claim 8 wherein the unloading ram system is capable of releasing a label held by its vacuum tube by an interruption in the vacuum to the vacuum tube.

* * * * *